United States Patent [19]

Drew et al.

[11] Patent Number: 4,592,616

[45] Date of Patent: Jun. 3, 1986

[54] CONNECTOR FOR COAXIAL TELEVISION CABLE

[75] Inventors: Thomas J. Drew, New Baltimore; Frank S. Day, Detroit, both of Mich.

[73] Assignee: Armex Cable Corporation, Warren, Mich.

[21] Appl. No.: 591,398

[22] Filed: Mar. 15, 1984

[51] Int. Cl.[4] ..... H01R 17/04

[52] U.S. Cl. ..... 339/177 R; 174/151; 333/244

[58] Field of Search ..... 339/177 R, 177 E; 174/71 C, 75 C, 88 C, 89, 111, 151, 152 R, 152 GM, 152 S, 153 R; 333/244, 260

[56] References Cited

U.S. PATENT DOCUMENTS

| | | | |
|---|---|---|---|
| 2,120,890 | 6/1938 | Figard | 174/152 S |
| 2,997,530 | 8/1961 | Rosan | 174/153 R |
| 3,100,289 | 8/1963 | Lorch | 174/88 C |
| 3,437,982 | 4/1969 | O'Keefe et al. | 339/177 R |
| 3,492,408 | 1/1970 | Forney, Jr. et al. | 339/177 R |
| 4,261,630 | 4/1981 | Knappenberger | 339/177 R |
| 4,368,940 | 1/1983 | Sugiura | 339/177 E |

FOREIGN PATENT DOCUMENTS

| | | | |
|---|---|---|---|
| 1057190 | 5/1959 | Fed. Rep. of Germany | 174/152 R |

*Primary Examiner*—Neil Abrams

*Attorney, Agent, or Firm*—Barnes, Kisselle, Raisch, Choate, Whittemore & Hulbert

[57] ABSTRACT

A connector assembly for coaxial television cable used especially for signal connection between two housing mounts. A conductor rod has a multiple-land dielectric spool molded centrally between the ends leaving exposed conductive ends extending from the spool. A housing for the rod consists of two enclosing elements joined by a threaded collar and having threaded extensions to be received in a housing mount.

2 Claims, 3 Drawing Figures

CONNECTOR FOR COAXIAL TELEVISION CABLE

FIELD OF INVENTION

Connectors for television cable and more particularly housing-to-housing connectors.

BACKGROUND AND FEATURES OF THE INVENTION

In the installation of cable television throughout extensive geographical areas, many thousands of feet of cable, even miles of cable, are suspended on available poles. This cable system involves also the use of many metal housings which frequently must be located adjacent each other with a cable connection between them. The cable must be insulated from the housings and from the mechanical connector between the housings.

In the previous practice, it has been common to select a copper rod to extend between two housings and slide on to the rod a locator clip which had to be centered on the rod to locate two additional tubular insulators on each side of the clip. This involved a plurality of parts and required assembly time. In addition, the parts did not always get properly placed on the rod which caused difficulties in the housing-to-housing connection.

The present invention contemplates a new connector which is an integral unit requiring no pre-assembly and which is always properly centered with equal conductor rod ends to insert into adjacent housings. The device is easy to assemble and dismantle and eliminates the placing of the centering clip previously used. The structure of the present invention is also such that the bonded location on a conductor together with the shape of the locator provides a radial stand-off for the conductor which provides a configuration which tunes and balances the impedance and conductance of the connector to render it more efficient in the coaxial cable circuit.

Other objects and features of the invention will be apparent in the following description and claims in which the invention is described together with details to enable a person skilled in the art to practice the invention, all in connection with the best mode presently contemplated for the invention.

BRIEF DESCRIPTION OF THE DRAWINGS

DRAWINGS accompany the disclosure and the various views thereof may be briefly described as follows.

DETAILED DESCRIPTION OF THE INVENTION AND THE MANNER AND PROCESS OF USING IT

Figure 1:
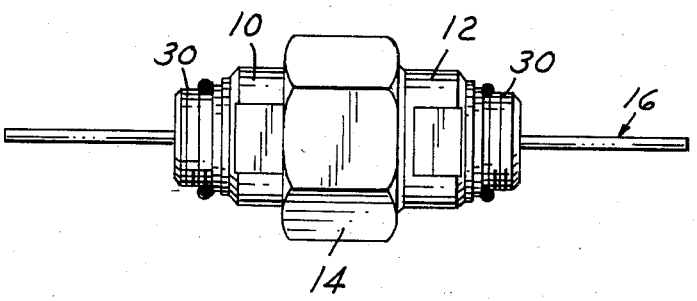
FIG. 1, an elevation of the completed housing-to-housing connector.
Figure 2:
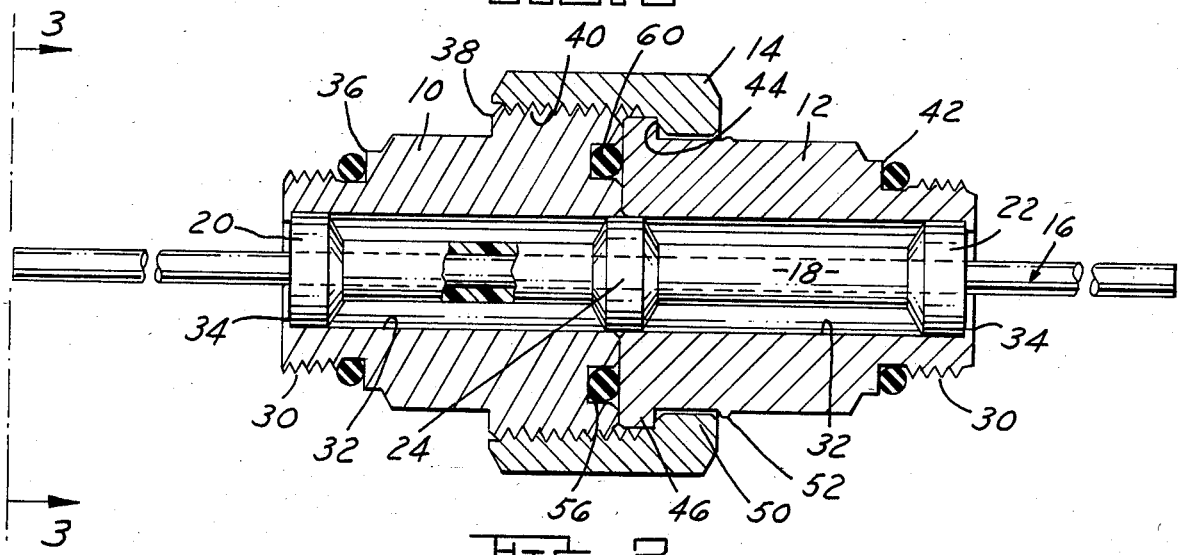
FIG. 2, a longitudinal section of the assembly illustrated in FIG. 1.
Figure 3:
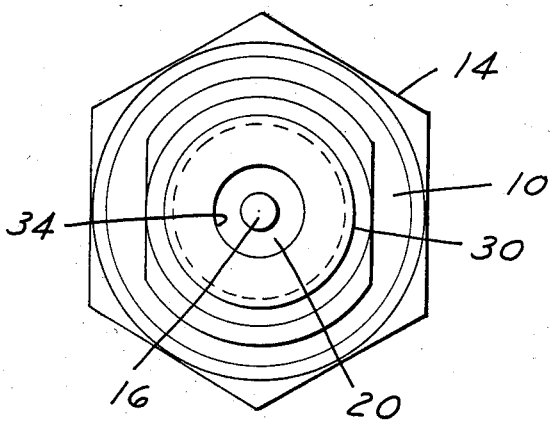
FIG. 3, an end view on line 3—3 of FIG. 2.

The assembly of this invention is composed of two housing elements 10 and 12 on a common axis with a connector ring 14. The fourth element is a conductor rod 16 having a plastic and dielectric sheath 18.

The conductor wire or rod 16 has the dielectric sheath 18 molded directly to the rod in such a manner that it is bonded to the rod and, under ordinary stresses to which it may be subjected, will not shift from its central position. Thus, the bare ends of the rod extend to each side of the plastic sheath in equal dimensions.

The sheath is preferably formed of a dense plastic such as Nylon, Teflon or a foamed polyurethane. Clear plastic is best but some filler may be used.

The sheath 18 is in the form of a double spool with end lands 20 and 22 and a central land 24. The portion of the sheath between the lands is of reduced diameter such, for example, as one-half the dimension of the lands.

Each housing 10 and 12 has a threaded end 30 with O-rings 31 at the base and an inside bore 32 with a diameter to receive in a snug sliding fit the lands 20, 22 and 24. At each threaded end there is an internal retaining lip 34 to confine and axially locate the end lands 20 and 22.

Housing 10 increases in diameter from the threaded end 30 at shoulders 36 and 38 to the largest diameter which is threaded at 40. Housing 12 increases in diameter at two shoulders 42 and 44 to the largest diameter which forms an annular flange 46.

The connector ring 14 is internally threaded at one end to match the external threads 40 on housing 10. The other end of ring 14 has an internal flange 50 which cooperates with the external flange 46. A small external annular ridge 52 serves to retain the ring 14 on the housing 12.

Each housing 10 and 12 has an inner face in a plane transverse to the axis of the assembly. An O-ring groove 56 holds an O-ring 60 so that when the inner faces of the housing are brought together, the faces will be sealed. O-rings at the base of the threaded ends 30 will seal the connector in assembly on the housings into which the ends are threaded.

In assembly, there is flexibility since one housing, 10 or 12, can be screwed into an established and mounted cable box or housing. The sheathed conductor can be inserted into the bore of the mounted housing end. Then the other housing can be brought into assembly over the sheathed conductor and screwed into a second cable box. Then the ring 14 can be tightened on the threads 40 to bring both housings 10 and 12 into tight relationship. This assembly insures that conductor ends extend from the assembly in equal dimension. The device is easy to assemble or diassemble.

The balanced design insures a stable capacitance and inductance of the fitting and a better decibel transfer. The conductors are always perfectly centered and cannot get out of line. In addition, the bonded assembly on the conductor insures a suitable and consistent radial stand-off of the conductor and the configuration tunes and balances the impedance and conductance of the connector to render it more efficient in the overall coaxial cable system.

What is claimed is:

1. For use with coaxial cable television line housings which are formed of conductive metal, closely spaced, and each having aligned threaded recesses, a housing-to-housing connection for the internal conductor of a coaxial television cable which comprises:

(a) a first conductive connector element having a threaded end to be received in a threaded recess of one housing and having a central bore, said bore having an inturned lip at the outer end, (b) a second conductive connector element having a threaded end to be received in a threaded recess of a second housing and having a central bore to align with the bore of said first element, said bore having an inturned lip at the outer end, (c) means to secure said connector elements together with said bores in alignment comprising a collar engaging an annular shoulder on one element and threadingly engaging threads on an inner end of the other of said elements, and (d) a separable, integral conductor and insulator unit to be removably captured within said connector elements comprising a length of straight, solid conductor wire having a diameter much smaller than said bores to connect the internal conductor of a coaxial cable of said spaced housings and having a length to project out of the threaded ends of each of said connector elements and into said spaced housings, and an axial and radial locator molded on and bonded to said conductor wire centrally between the ends having a spool land at each end fitting within said aligned bores of said connector elements and confined axially between said lips of said bores, the intermediate portions of said locator covering said wire and having a diameter reduced from that of said bores and said spool lands.

2. A conductor component to be utilized to connect the internal conductor of coaxial television cables of separate, spaced-apart cable housings which comprises a straight solid conductor wire, and a dielectric locator sheath molded on and bonded to said wire centrally between the ends thereof leaving wire extensions at each end and having radial spacer lands at each end of the sheath, said lands having a diameter substantially larger than said sheath, said lands and said sheath to be removably confined within a pair of mechanically joined conductive connector elements, one of which is affixed to each of said separate cable housings and with the wire extensions at each end extending into different ones of the cable housings.

* * * * *